US006518947B1

(12) United States Patent
Kim

(10) Patent No.: US 6,518,947 B1
(45) Date of Patent: Feb. 11, 2003

(54) LCD COLUMN DRIVING APPARATUS AND METHOD

(75) Inventor: Dae-Seong Kim, Kyungsangbuk-Do (KR)

(73) Assignee: Hyundai Electronics Industries Co., Ltd., Kyoungki-do (KR)

( * ) Notice: Subject to any disclaimer, the term of this patent is extended or adjusted under 35 U.S.C. 154(b) by 0 days.

(21) Appl. No.: 09/524,391

(22) Filed: Mar. 13, 2000

(30) Foreign Application Priority Data

Mar. 30, 1999 (KR) ..... 99-11007

(51) Int. Cl.[7] ..... G09G 3/36

(52) U.S. Cl. ..... 345/100; 345/87; 345/92; 345/98

(58) Field of Search ..... 345/87, 90, 92, 345/93, 94, 98–99, 100

(56) References Cited

U.S. PATENT DOCUMENTS 5,528,256 A 6/1996 Erhart et al. ..... 345/96
5,574,633 A 11/1996 Prater ..... 363/59
5,635,865 A * 6/1997 Moon et al. ..... 327/108
5,686,935 A * 11/1997 Weisbrod ..... 345/100
5,764,225 A * 6/1998 Koshobu ..... 345/211
6,201,522 B1 * 3/2001 Erhart et al. ..... 345/209
6,297,596 B1 * 10/2001 Kajihara ..... 315/160

* cited by examiner

*Primary Examiner*—Richard Hjerpe
*Assistant Examiner*—Duc Q. Dinh
(74) *Attorney, Agent, or Firm*—Morgan, Lewis & Bockius LLP

(57) ABSTRACT

A column driving apparatus for TFT (thin film transistor) LCD (liquid crystal display) includes a data processing unit for generating a constant analog signal in accordance with an input data, a driving unit for receiving the analog signal from the data processing unit and outputting an analog voltage at an output terminal, and a control unit for selectively connecting the output terminal of the driving unit, a positive predriving terminal, a negative predriving terminal and a charge distribution terminal to pixels of the liquid crystal display. The apparatus decreases charge distribution time using a common line, and decreases pixel driving time and power by predriving the pixels using a potential approximate to the pixel driving potential.

6 Claims, 3 Drawing Sheets

FIG. 3
BACKGROUND ART
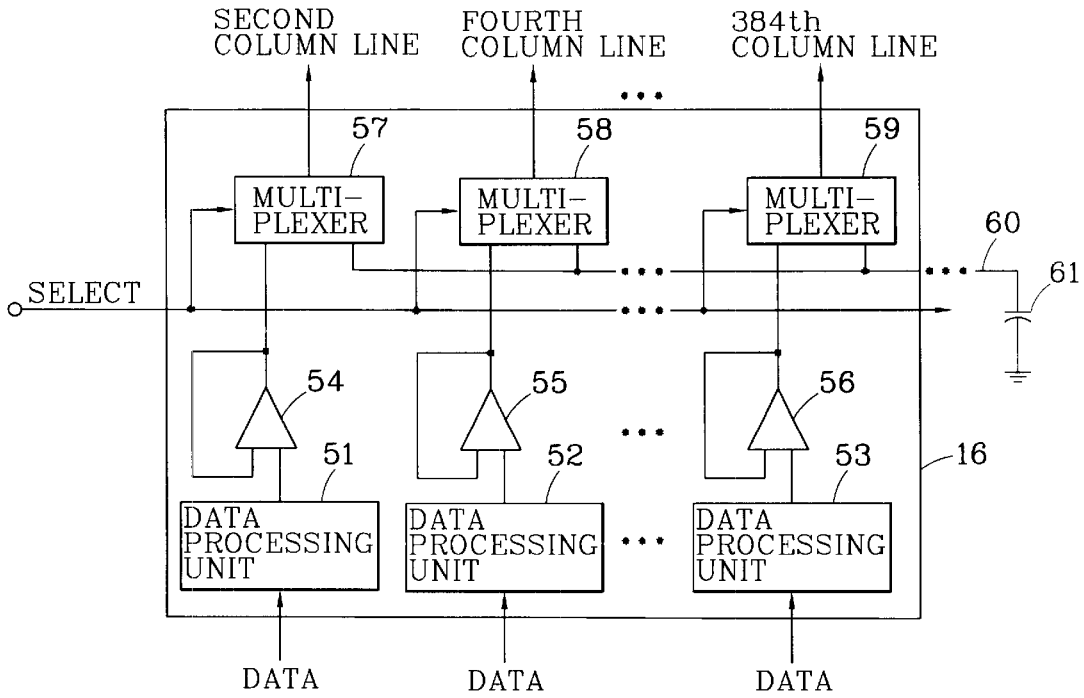
FIG. 4A
BACKGROUND ART
FIG. 4B
BACKGROUND ART
FIG. 4C
BACKGROUND ART
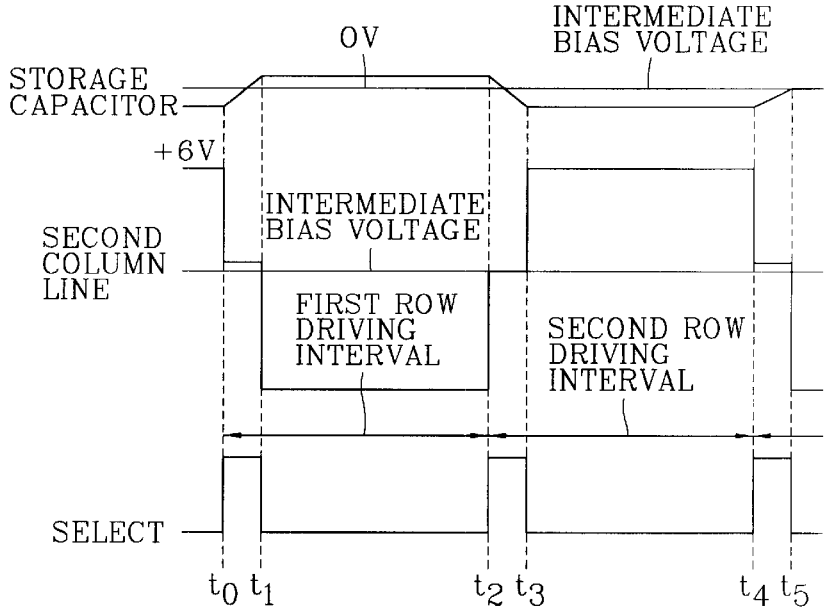

Cso : PIXEL CAPACITOR DRIVING CONNECTED TO ODD NUMBER COLUMNS
Cse : PIXEL CAPACITOR DRIVING CONNECTED TO EVEN NUMBER COLUMNS

LCD COLUMN DRIVING APPARATUS AND METHOD

This Application claims the benefit of Korean Patent Application No. 11007/1999 filed on Mar. 30, 1999, which is hereby incorporated by reference.

BACKGROUND OF THE INVENTION

1. Field of the Invention

The present invention relates to a column driving apparatus of a thin film transistor (TFT) liquid crystal display (LCD), and more particularly, to an LCD column driving apparatus capable of achieving an improved picture quality and reduced chip size and production cost.

2. Description of the Related Art

FIG. 1 is a block diagram of a general active matrix display system. As shown in FIG. 1, the active matrix LCD display screen is designed in accordance with a matrix array 1 including 480 rows by 640 columns for a typical black/white gray-scale LCD display. The typical color LCD display requires 1920 columns, i.e., three times the 640 columns applicable to a black/white LCD display, so as to express three primary colors at respective pixels on a display screen. Pixels are formed at respective intersections of columns and rows. When rows are selected, a TFT connects the column voltage to the pixel capacitor in each pixel. The intensity of respective pixels is determined by the voltage applied to the pixel capacitor in each pixel of the screen display.

Respective refresh phases of a display and 480 rows during the display cycle are each selected by row drivers 2, 3, 4. This enables a TFT transistor at the selected row and applies the present voltage of 640 columns to be stored in the pixel capacitor at the respective 640 pixels of the selective rows. As shown in FIG. 1, ten column driving integration circuits 11–20 each drive 64 columns (192 columns in case of a color display) out of the 640 columns of the black/white LCD display.

A control circuit (not shown) applies data and a control signal to all the row drivers 2–4 and column drivers 11–29 for synchronizing respective elements so that a desired image can be displayed.

FIG. 2 is a view detailing a portion of the matrix array 1 in FIG. 1. As shown in FIG. 2, a first row line is connected to the gate of each of two MOS TFT transistors 31, 32 and similarly a second row line is connected to two MOS TFT transistors 33, 34. A first column line is connected to the drains of the transistors 31, 33, and a second column line is connected to the drains of the transistors 32, 34. When the pixel formed at the intersection of the first and second column lines is refreshed or updated, the first row line becomes driven so as to enable the transistors 31, 32.

At this time, the column driving output voltage applied to the first column line is applied through the transistor 31 and enables the pixel capacitor 41 for storing an analog voltage according to a desired gray brightness for that specific pixel. Similarly, the column driving output voltage applied to the second column line is applied through the transistor 32 and enables the pixel capacitor 42 for storing an analog voltage according to a desired gray brightness for that specific pixel.

When the first row line is turned to low, the transistors 31, 32 become turned off and the analog voltage applied to the pixel capacitors 41, 42 is maintained until they are updated in accordance with the subsequent refresh cycle. The second row line is enabled and the analog voltage applied to the first and second column lines apply a desired gray brightness voltage to update and store appropriate charges in the respective pixel capacitors 43, 44.

The first row line is selected during the first row driving interval and the second row line is selected during the second row driving interval. After the 480th row driving interval, the second display cycle begins.

Assuming that a row inversion is simply employed without column inversion, a positive polarity voltage is applied to all the column lines including the first and second column lines during the first display cycle and at a time when the first row line is selected in accordance with the first row driving interval. Therefore, the pixels including the pixel capacitors 41, 42 in the first row line are charged with positive polarity. Then, the second row line is selected during the row driving interval. However, the negative polarity voltage is applied to all the column lines including the first and second column lines. Accordingly, all the pixels including the pixel capacitors 43, 44 connected to the second row line are charged with negative polarity. Such an operation is repeated with regard to 239 pairs of row lines remaining in the arrays.

When the first row line is selected during the next display cycle, the negative polarity voltage is applied to all the column lines including the first and second column lines. Therefore, the pixels including the pixel capacitors 41, 42 connected to the first row line are charged with negative polarity. Similarly, during the subsequent driving interval, the second row line is selected. However, the positive polarity voltage is applied to all the column lines including the first and second column lines. So, the pixels including the pixel capacitors 43, 44 connected to the second row line are charged with positive polarity. The direct current voltage applied to respective pixels becomes averaged with an intermediate bias voltage.

The column driving circuit 11 needs to set the first column line, for example, at +6V during the first row driving interval of the first display cycle, and the first column is required to be set, for example, at −6V during the subsequent row driving interval with regard to the second row line. According to these examples, the column driver 11 has to be transited from +6V to −6V with regard to all the row driving cycles of all the display cycles. The respective column driving circuits from the second column line to 640th column line (for black/white LCD display) are operated as follows.

FIG. 3 is a view detailing a column driving integration circuit 16. As shown in FIG. 3, a common terminal of the respective column driving integration circuits is connected to the common line 60. An external storage capacitor 61 is connected between the common line 60 and ground voltage.

Referring to FIG. 3, the analog voltage for driving the respective column lines including the second column line stored in data processing units 51, 52, 53 is applied to unit gain amplifiers 54, 55, 56. The respective outputs of the unit gain amplifiers 54, 55, 56 are selectively connected to the external storage capacitor 61 through a pixel or the common line 60 in accordance with multiplexers 57, 58, 59 controlled by a control signal SELECT.

The respective multiplexers 57, 58, 59 each include a column terminal connected to a column of an array, an input terminal connected to the output of one of the unit gain amplifiers 54, 55, 56, a common terminal connected to the external storage capacitor 61 via the common line 60, and a control terminal receiving the control signal SELECT.

The multiplexers 57, 58, 59 electrically connect the column terminal to the common terminal when the control signal SELECT is in a high potential and connect the column terminal to the input terminal when the control signal SELECT is in a low potential. That is, when the control signal SELECT is in a high potential, the multiplexers 57, 58, 59 connect respective column lines of the LCD array to the external storage capacitor 61 at a start point of the row driving interval. Here, the value of the storage capacitor 61 is set as a much larger value than a value obtained by multiplying a pixel capacitor value and the column number of the LCD array.

With reference to FIGS. 4A–4C, the column driving operation will now be described in detail.

First, when the control signal SELECT is in a high potential, the first region is set between the first start point t0 and the second start point t1. When the control signal is in a low potential, the second region is set between the second point t1 and the third point t2.

If the voltage of the second column line is +6V just prior to the first point t0, the first row line is selected at the first time point t0 and the control signal SELECT becomes a high potential, so that the second column line is connected to the storage capacitor 61 by the multiplexer 57. Then, the second column line voltage is dropped to about 0V.

At the second time point t1, the second region begins with regard to the first row driving interval and the multiplexer 57 connects the output of the unit gain multiplexer 54 to the second column line, thereby driving the second column line from 0V to −6V.

Also, at the third time point t2, the subsequent row driving interval begins and the second row line is selected. The pixel connected between the second row line and the second column line is charged with negative polarity so that the control signal SELECT becomes a high potential, whereby the second column line is connected to the storage capacitor 61 by the multiplexer 57. Accordingly, the voltage at the second column line is raised to about 0V.

At the fourth time point t3, the second region of the second row driving interval begins and the multiplexer 57 connects the unit gain amplifier 54 to the second column line so as to drive a polarity voltage opposite to that of the first row driving interval, so that the second column line is driven from 0V to +6V.

Such an operation is repeatedly carried out with regard to all the row driving intervals.

As shown in FIGS. 4A–4C, the electric charge stored in the pixel capacitor is discharged to the storage capacitor 61 during the first region of the respective row driving interval. The storage capacitor 61 averages the voltage applied to the array column. For instance, in case that the highest positive voltage is +6V and the lowest negative voltage is −6V, the intermediate bias voltage becomes approximately 0V and accordingly the storage capacitor 61 has about 0V.

Also, as shown in FIG. 3, the multiplexers 57, 58, 59 selectively connect the driving voltage applied to the column line generated by the unit gain amplifiers 54, 55, 56 so as to charge the pixels connected to the selected rows during the second region of the respective driving interval. If the pixels connected to the first row line and second column line are charged with +6V during the present row driving interval, the pixels should be driven at −6V. However, as shown in FIGS. 4A–4C, since the second column line is discharged from +6V to 0V during the first region of the row driving interval, the unit gain amplifiers 54, 55, 56 are required to charge the second column line from 0V to −6V.

As described above, the conventional art employs an external storage capacitor and requires the storage capacitor to be sufficiently large so as to distribute charges. As a result, the storage capacitor requires a long time period to be charged with an intermediate bias voltage. Accordingly, the picture quality of the LCD display remains unclear for a certain period of time after power is supplied to the LCD panel. In order to overcome such a problem, the storage capacitor should be densely charged with the potential of a back panel. Further, in the conventional LCD, the driving time should be sufficiently long to drive a frame having a large difference of average potentials of pixels. This causes another problem in that an additional buffer for the LCD panel without distributing electric charges is required.

SUMMARY OF THE INVENTION

Accordingly, the present invention is directed to a LCD column driving apparatus and method that substantially obviate one or more of the problems due to limitations and disadvantages of the related art.

An object of the present invention is to provide an LCD panel column driving apparatus which is capable of decreasing charge distribution time using a common line, and decreasing pixel driving time and power by predriving the pixels using a potential close to the pixel driving potential in accordance with an external bias voltage. Another object of the present invention is to provide an LCD panel column driving apparatus capable of decreasing a driving current using an electric charge stored in a pixel of a previous frame, improving picture quality by arriving at a desired value within a short driving time period, and decreasing chip size and production cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described a column driving apparatus for an LCD panel according to the present invention includes a data processing unit for generating a constant analog signal in accordance with an input data, a driving unit for receiving the analog signal from the data processing unit and outputting an analog voltage at an output terminal, and a control unit for selectively connecting the output terminal of the driving unit, a positive predriving terminal, a negative predriving terminal and a charge distribution terminal of the driving unit to pixels of the liquid crystal display.

In another aspect of the present invention, a column driving method for a liquid crystal display having a column driving apparatus for driving a pixel array, includes the steps of connecting pixels to a common line for a charge distribution; predriving the pixels in accordance with polarity of the pixels driven in a previous frame; and driving the pixels in accordance with an input data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3 is a circuit view detailing a conventional column driving apparatus in the block diagram of FIG. 1;

FIGS. 4A–4C are waveform views illustrating the active matrix LCD display using a column driving apparatus according to the conventional art in FIG. 3;

DETAILED DESCRIPTION OF THE PREFERRED EMBODIMENTS

Reference will now be made in detail to the preferred embodiments of the present invention, examples of which are illustrated in the accompanying drawings.

Figure 1:
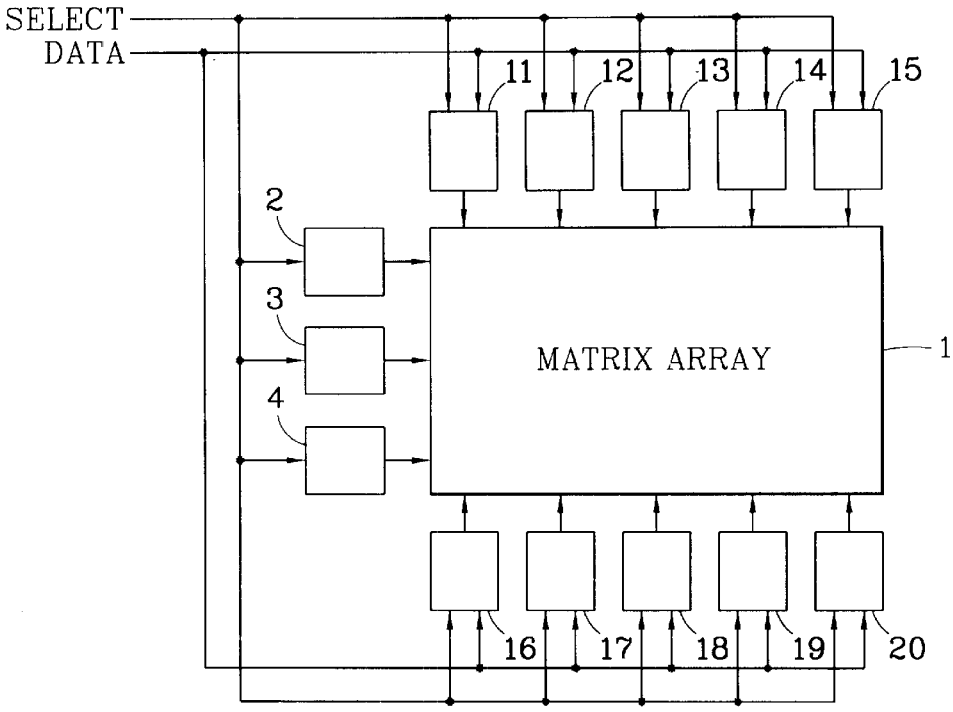
FIG. 1 BACKGROUND ART
FIG. 1 is a block diagram illustrating an active matrix LCD display including a column driving circuit and a row driving circuit for driving a pixel array provided in a general LCD display.
Figure 2:
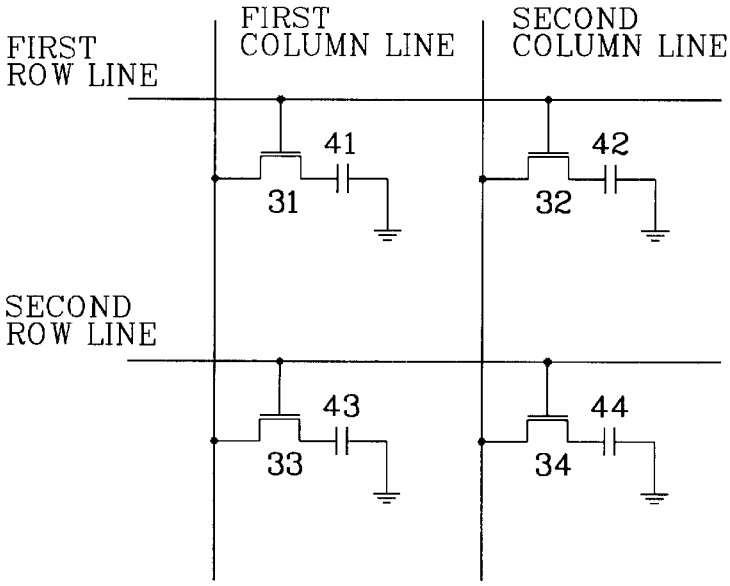
FIG. 2 BACKGROUND ART
FIG. 2 is a circuit view detailing main portions of the general active matrix LCD display in FIG. 1.
Figure 5:
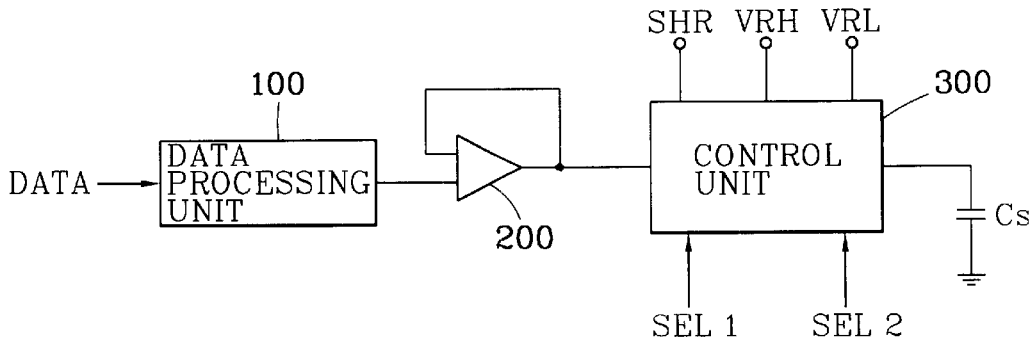
FIG. 5 is a circuit view illustrating a column driving apparatus for an LCD display according to the present invention.
Figure 6:
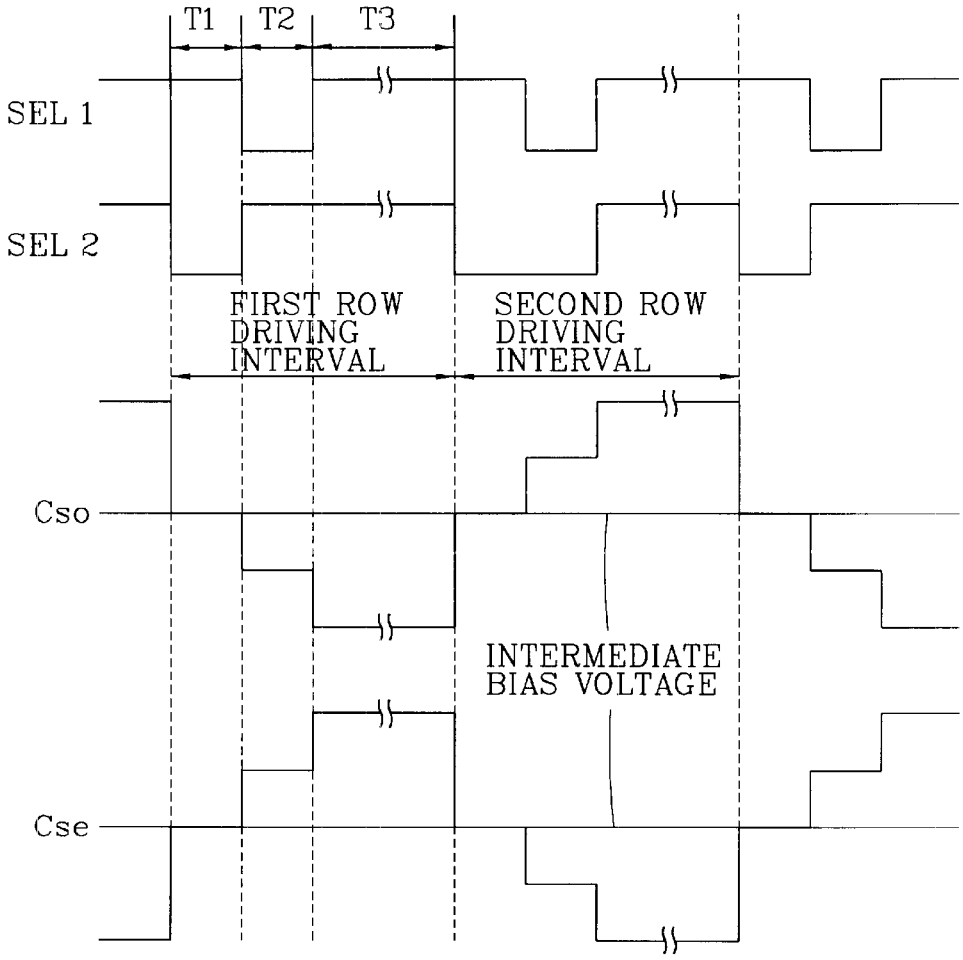
FIG. 6 are waveform views illustrating an LCD display using the column driving apparatus according to the present invention in FIG. 5.

FIG. 5 is a circuit view illustrating a column driving apparatus for an LCD display according to the present invention. As shown in FIG. 5, the apparatus includes a data processing unit 100 for generating a constant analog signal in accordance with an input data, a driving unit 200 for receiving an analog signal from the data processing unit 100 and outputting an analog voltage to a column line so as to drive pixels, a control unit 300 for selectively connecting an output terminal of the driving unit 200, a positive predriving terminal VRH, a negative predriving terminal VRL or a charge distribution terminal SHR in accordance with the first and second control signals SEL1, SEL2.

The operation of the LCD display using a column driving apparatus of the present invention will now be described with reference to waveform views of FIGS. 6A–6D.

First, in the first region T1 where the first control signal SEL1 is in a high potential and the second control signal SEL2 is in a low potential, the control unit 300 connects all the pixels connected to the selected row lines to the charge distribution terminal SHR so as to charge-distribute all the pixels. At this time, the charge distribution terminal SHR is connected to a common line and all the pixels are connected in common to the common line.

Next, in a second region T2 when the first control signal SEL1 is in a low potential and the second control signal SEL2 is in a high potential, the control unit 300 connects all the pixels driven in a low potential at the previous frame to a positive predriving terminal VRH so that the pixels are predriven by a positive bias voltage VDH. At this time, all the pixels driven in a high potential at the previous frame is connected to the negative predriving terminal VRL so as to be predriven by an external negative bias voltage VDL.

In a third region T3 where the first control signal SEL1 is in a high potential and the second control signal SEL2 is in a high potential, the pixels are connected to an output terminal of the driving unit 200 in accordance with the operation of the control unit 300 and driven by the input data.

Such an operation is repeated during a time period when all the row lines are selected for the driving.

The operation of the column driving apparatus for the LCD display according to the present invention will now be described in further detail.

First, when the first control signal SEL1 is in a high potential and the second control signal SEL2 is in a low potential, the control unit 300 connects all the pixels to the charge distribution terminal SHR for the charge distribution. At this time, the charge distribution terminal SHR is connected to a common line so that all the pixels are connected in common to the common line. Accordingly, the charges charged in the respective pixels of the previous frame become an intermediate bias voltage VSH by charges and discharges thereof. Here, the intermediate bias voltage VSH satisfies the following:

$$VSH = \sum_{i=1}^{P} \frac{Vpxi}{P}$$

wherein, P denotes the column number, and Vpxi denotes a pixel voltage connected to the i-th column.

The intermediate bias voltage VSH is an average value of the driving voltages applied to all the pixels connected to the row during the previous frame.

Then, when the first control signal SEL1 is in a low potential and the second control signal SEL2 is in a high potential, the control unit 300 connects the selected pixels to the predriving terminal so as to predrive the pixels by an external bias voltage. Here, since the pixels driven by the positive polarity at the previous frame should be driven by the negative polarity in the current frame, the pixels are connected to the negative predriving terminal VRL for predriving the same to a voltage approximate to the driving voltage. Also, since the pixels driving by the negative polarity at the previous frame should be driven in a positive polarity at the current frame, the pixels are connected to the positive predriving terminal VRH for driving the same using an external bias voltage VDH and predriven to the voltage approximate to the driving voltage.

Subsequently, when the first control signal SEL1 and the second control signal SEL2 are all in high potential, all the predriven pixels are connected to the output terminal of the respective driving units and driven in accordance with the input data.

The same operation is repeated with regard to all the rows of the LCD display.

As described above, the column driving unit according to the present invention employs an external bias voltage and predrives respective pixels to a potential approximate to the driving potential, and then drives the pixels in accordance with the data, thereby decreasing the driving current of the driving unit and decreasing the chip size. Further, the time required to drive the pixels to the data value is decreased, thereby improving the picture quality. Moreover, since the driving time is decreased, the power consumption of the driving unit is significantly decreased.

It will be apparent to those skilled in the art that various modifications and variations can be made in the LCD column driving apparatus and method of the present invention without departing from the spirit or scope of the invention. Thus, it is intended that the present invention cover the modifications and variations of this invention provided they come within the scope of the appended claims and their equivalents.

What is claimed is:

1. A column driving apparatus for a liquid crystal display, comprising:

a data processing unit for generating a constant analog signal in accordance with an input data;

a driving unit for receiving the analog signal from the data processing unit and outputting an analog voltage at an output terminal; and a control unit for selectively connecting the output terminal of the driving unit, a first predriving terminal, a second predriving terminal, and a charge distribution terminal to pixels of the liquid crystal display.

2. The apparatus of claim 1, wherein the control unit is controlled by first and second control signals.

3. The apparatus of claim 1, wherein first and second voltages having opposite polarities are applied to the first and second predriving terminals.

4. The apparatus of claim 3, wherein the first and second voltages are each determined based on the input data and an intermediate voltage between a negative polarity voltage and apositive polarity voltage.

5. The apparatus of claim 3, wherein the first and second voltages are external bias voltages.

6. The apparatus of claim 1, wherein the charge distribution terminal is connected to a common line.

* * * * *